United States Patent [19]

Won

[11] Patent Number: 4,624,411

[45] Date of Patent: Nov. 25, 1986

[54] SELF-PROPELLED, ROTARY, LIQUID ATOMIZER

[76] Inventor: Vann Y. Won, 6697 Gloria Dr., Sacramento, Calif. 95831

[21] Appl. No.: 689,738

[22] Filed: Jan. 8, 1985

[51] Int. Cl.[4] ..... B05B 3/04; B05B 3/10

[52] U.S. Cl. ..... 239/222.19; 239/223; 239/261; 415/92; 415/202

[58] Field of Search ..... 239/214, 261, 214.13, 239/214.15, 214.21, 222.11, 222.17, 222.19, 223–225, 380, 381, 251, DIG. 14; 415/92, 202, 81; 416/171

[56] References Cited

U.S. PATENT DOCUMENTS

| | | | |
|---|---|---|---|
| 409,978 | 8/1889 | Kisinger | 239/214 |
| 662,236 | 11/1900 | Johnston . | |
| 2,408,511 | 10/1946 | Gothard | 239/222.19 |
| 2,815,246 | 12/1957 | Nyrop | 299/63 |
| 2,836,464 | 5/1958 | Dickinson | 299/63 |
| 2,969,188 | 1/1961 | Guigues et al. | 239/261 X |
| 3,081,949 | 3/1963 | Simmons | 239/383 |
| 3,125,297 | 3/1964 | Copeland et al. | 239/261 |
| 3,659,957 | 5/1972 | Yuen | 416/179 |
| 4,044,081 | 8/1977 | Weidlich | 261/51 |
| 4,222,523 | 9/1980 | Bals | 239/216 |
| 4,511,084 | 4/1985 | Won | 239/223 |
| 4,582,255 | 4/1986 | Won | 239/222.19 |

FOREIGN PATENT DOCUMENTS

| | | | |
|---|---|---|---|
| 155040 | 6/1938 | Austria | 239/261 |

*Primary Examiner*—Joseph F. Peters, Jr.
*Assistant Examiner*—Mary Beth O. Jones
*Attorney, Agent, or Firm*—Jacob N. Erlich; Donald J. Singer

[57] ABSTRACT

A self-propelled, rotary liquid atomizer having a feed tube and a rotor operably connected at the bottom thereof. The feed tube is hollow and is affixed to the inlet line of a pressurized liquid source. This liquid source is not only atomized but serves as the motor force for the atomizer. A plurality of slits are formed at the bottom of feed tube and they are juxtaposed a plurality of cup-like openings and holes formed in the rotor. As the liquid under pressure is passed through the feed tubes it exits from the slits at the bottom of the feed tube and impinges upon the cup-like openings within the rotor to cause the rotation thereof. This high speed rotation causes the rotor to act as a fly wheel spinning at such high speed that it increases the momentum of the liquid forcing it up and along the walls of the rotor and out through the openings therein. As the liquid reaches the openings at the top of the rotor, it is sheared into fine droplets and sprayed/atomized at 360° around the rotor.

4 Claims, 3 Drawing Figures

SELF-PROPELLED, ROTARY, LIQUID ATOMIZER

STATEMENT OF GOVERNMENT INTEREST

The invention described herein may be manufactured and used by or for the Government for governmental purposes without the payment of any royalty thereon.

BACKGROUND OF THE INVENTION

This invention relates generally to an apparatus for atomizing liquids, and, more particularly, to a liquid atomizer which is self-propelled and capable of operating efficiently in a vacuum or under sub-ambient pressure conditions.

There are many instances when it becomes necessary to physically separate a substance from a liquid in which it is mixed or in which it is contained. For example, a nonvolatile liquid such as hydraulic fluid, which is used in the hydraulic test stands of aircraft repair systems, becomes unserviceable when the chlorine content thereof reaches 50 parts per million. The source of the chlorine within the hydraulic fluid is found in the chlorinated solvents which are used within the aircraft repair system for cleaning and/or degreasing on the test stands. These chlorinated solvents are extremely volatile while the hydraulic fluid, as stated above, is nonvolatile.

Although distillation procedures have been used in the past for the separating of such liquids, it has been recognized by the inventor, as exemplified in U.S. Pat. No. 4,432,775 issued to this inventor on Feb. 21, 1984, that the utilization of an atomization technique, in which the substance can be atomized to form a fine mist in a low pressure (vacuum) environment in order to easily withdraw or separate this fine mist or vapor from the liquid, is feasible. Such an atomization system incorporates therein an atomizer of the type set forth by this inventor (formerly known as Yuen) in U.S. Pat. No. 3,659,957 issued May 2, 1972 or with appropriate modification incorporates therein the type of atomizer described in U.S. patent application Ser. No. 493,885 filed on May 12, 1983 and now U.S. Pat. No. 4,511,084 issued Apr. 16, 1985 by the present inventor. Although the type of atomizers disclosed in the above-mentioned U.S. Pat. Nos. 3,659,957 and 4,511,084 are operational in vacuum or under sub-ambient pressure conditions, it is desireable to find alternative atomizers which are more effective and reliable in separating a volatile substance from a nonvolatile liquid in a vacuum or under sub-ambient pressure conditions.

SUMMARY OF THE INVENTION

The present invention substantially modifies the atomizers described above such that it is exceptionally well suited for the atomization of a liquid in a vacuum or under sub-ambient pressure conditions.

The present invention replaces the motive power for past atomizers, generally in the form of an electric motor, with the liquid itself in conjunction with a novel construction of an atomizer. Consequently, the atomizer of the present invention is in the form of a self driven, rotary, liquid atomizer. Making up the present invention are three main components: (1) a feed tube, (2) a rotating dispersion cylinder or rotor, and (3) a pressurized liquid source. The feed tube is in the form of a hollow shaft which does not rotate and through which the liquid is fed under pressure The fluid leaves this feed tube through a plurality of slits located at the bottom end of the tube. The flow rate of the fluid or liquid exiting these slits can be varied by either varying the fluid flow rate itself entering the shaft or by altering the size of the exit slits at the end of the feed tube or shaft. In such a manner the desired fluid velocity through these exit slits can be controlled. This desired velocity will vary in accordance with the viscosity and the temperature of the liquid to be atomized.

Once the fluid leaves the exit slits of the feed tube at a preferred optimum angle of impingement this fluid impinges on a series of cup-like openings situated in the second part or rotating dispersion cylinder of the invention. The rotating dispersion cylinder is interconnected to the feed tube by means of a ball-bearing assembly which is secured to the bottom or closed end of the feed tube. As the fluid impinges upon these cup-like openings in the rotating dispersion cylinder, the cylinder rotates appropriately. The fluid exhausts its energy of momentum at the walls of the cup-like openings and is redirected to the top of the openings. In this redirection, the liquid layers of the fluid are sheared over one another causing the fluid to emerge as a mist from the top of the openings in a similar type of atomization procedure as set forth and described in detail within U.S. Pat. No. 3,659,957.

With the self-propelled, rotary, liquid atomizer of the present invention atomization can take place extremely effectively and reliably in a vacuum or under sub-ambient pressure conditions. The only source or mode of power for the atomizer is in the pressurized liquid itself. Since the liquid source is attached directly to the feed tube of the present invention there are no intervening components and the liquid always remains under pressure even in vacuum.

It is therefore an object of this invention to provide an apparatus for efficiently separating a substance from a liquid in which it is contained while in a vacuum or under sub-ambient pressure conditions.

It is still another object of this invention to provide a apparatus for efficiently separating a substance from a liquid in which the mode of force for operating the apparatus is derived directly from the liquid itself.

It is still a further object of this invention to provide a self-propelled, rotary, liquid atomizer which is capable of being incorporated in a wide variety of atomization systems.

It is still a further object of this invention to provide a self-propelled, rotary, liquid atomizer which is economical to produce and which utilizes conventional, currently available components that lend themselves to standard mass producing manufacturing techniques.

For a better understanding of the present invention, together with other and further objects thereof, reference is made to the following description taken in conjunction with the accompanying drawings and its scope will be pointed out in the appended claims.

DETAILED DESCRIPTION OF THE PREFERRED EMBODIMENT

Figure 1:
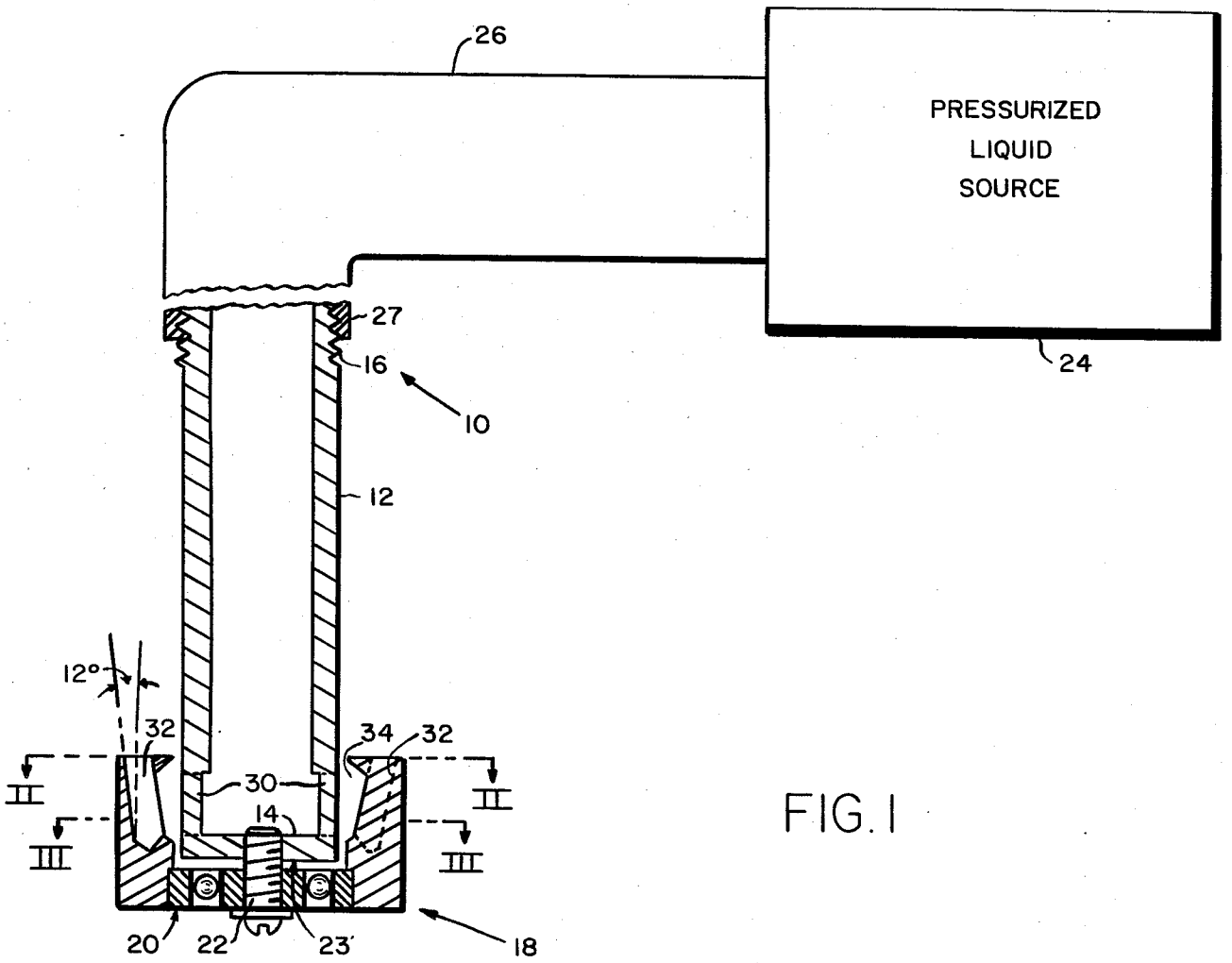
FIG. 1 is an enlarged side elevational view of the self-propelled, rotary, liquid atomizer of the present invention shown partly in cross section.

Reference is now made to FIG. 1 of the drawing which clearly illustrates the major components making up the self-propelled, rotary, liquid atomizer 10 of the present invention. Atomizer 10 of the present invention includes a hollow, elongated shaft or feed tube 12 closed at one end 14 and externally threaded at the other end 16 thereof. Attached adjacent the bottom end 14 of feed tube 12 is an annular-shaped rotatable dispersion cylinder or rotor 18. Rotor 18 is fixedly secured to a ball bearing assembly 20 which is rotatably secured to the bottom 14 of feed tube 12. As a result of this arrangement, rotor 18 can rotate about feed tube 12 under the influence of a pressurized liquid source in a manner to be described in detail hereinbelow. Any suitable bolt 22 affixes the ball bearing assembly 20 to the bottom 14 of feed tube 12 as illustrated in FIG. 1. A washer 23 is positioned between the bottom of feed tube 12 and the inner race of ball bearing assembly 20 to aid in the reduction of friction between elements.

The remaining component making up the present invention is a source of pressurized liquid 24 which is fed by means of inlet line 26 into the hollow portion of feed tube 12. Line 26 is internally threaded at end 27 so that feed tube 12 may threadably engage therewith. With such an arrangment as set forth in the present invention line 26 also acts as the support for the self-propelled, rotary, liquid atomizer 10 as well as a means of introducing the pressurized liquid into feed tube 12 in order to provide the motive force for atomizer 10.

Figure 2:
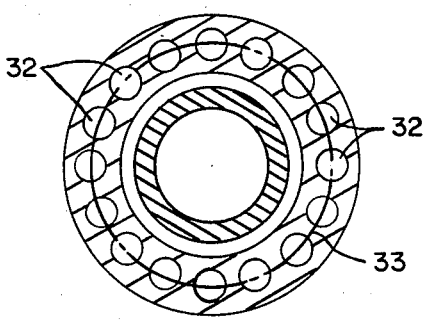
FIG. 2 is a cross sectional view of the self-propelled, rotary, liquid atomizer of the present invention taken along lines II—II of FIG. 1.
Figure 3:
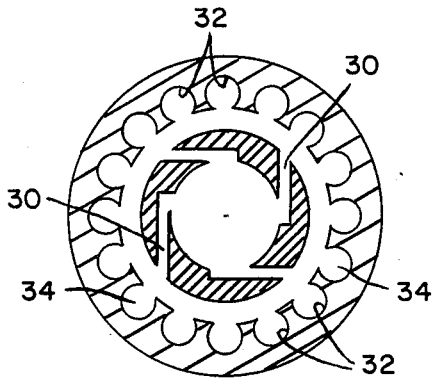
FIG. 3 is a cross sectional view of the self-propelled rotary, liquid atomizer of the present invention taken along lines III—III of FIG. 1.

Reference is now made to FIGS. 1-3 of the drawings for a more detailed description of the actual physical construction of feed tube 12 and rotor 18. As clearly shown in FIG. 3 of the drawings, feed tube 12 has located adjacent the bottom thereof a plurality (preferably 4 in number) of slits 30. These slits 30 are formed by precisely cutting, by an arc-electro discharge process, openings within the side wall of feed tube 12. These openings or slits 30 are generally 1/32 inch in width and extend approximately $\frac{1}{4}$ inch in height. Depth for the slits 30 are generally $\frac{1}{2}$ inch. Slits 30 are configured so as to be formed tangential to the circumference of the inside wall surface of feed tube 12. In this manner they are situated 90° along a radius drawn from the center of feed tube 12. Such a configuration adjacent the bottom of feed tube 12 enables the liquid under pressure to be forced through slits 30 in order to act as the motivating force in rotating rotor 18 in a manner to be described hereinbelow.

Referring more specifically to FIGS. 2 and 3 of the drawings, rotor 12 is shown in the form of an annular ring, preferably made of metal, and as stated above, is fixedly secured to the ball bearing assembly 20 for rotation therewith. Along the top periphery of rotor 18 are drilled a plurality of holes 32 of approximately $\frac{1}{8}$ inch diameter and preferably 16 in number. Holes 32 have their centers lying along a circle 33 having a diameter of approximately $\frac{3}{4}$ inch. As shown in FIG. 1 of the drawings, these holes 32 are drilled at a slope of approximately 12° from the vertical and are spaced approximately 22.5° apart (see FIG. 2). At approximately the mid level of rotor 18 and as shown in FIGS. 1 and 3 of the drawings cut-outs 34 are made for a height of approximately $\frac{1}{4}$ inch to create inside openings 34 of approximately 1/16 inch width within the walls of holes 32. These openings 34 face the slits 30 of feed tube 12. Cut-outs 34 together with holes 32 form a cup-like configuration which act as a turbine configuration in order to produce optimum rotor speed during rotation thereof. As the pressurized liquid from source 24 enters the hollow feed tube 12 it is forced down tube 12 and through the slits 30 against the cup-like configured holes 32 in order to not only rotate rotor 18 about feed tube 12 but also to create an action which allows for the upward movement of the liquid and consequent atomization of the liquid as it dispenses from the top of holes 32. The above dimensions are provided to illustrate an operational atomizer 10, however, it should be realized that these dimensions may be varied within the scope of the present invention.

MODE OF OPERATION

In operation, the liquid to be atomized is pumped by means of any conventional pumping means associated with liquid source 24 into feed tube 12 through line 26. Optimum results can be obtained at a liquid feed rate of approximately 3 gallons per minute. Under such conditions, the liquid is forced out of the four slits 30 at the bottom of feed tube 12. Theoretically, liquid exits these slits 30 at a linear speed of approximately 1848 feet per minute as calculated in the following manner:

$$1 \text{ gallon} = 231 \text{ in}^3 \text{ volume conversion}$$
$$(3 \text{ gallons})\,(231) = 693 \text{ in}^3 \text{ volume of liquid}$$

$$\frac{693 \text{ in}^3}{(4)\,(1/32'')\,(\frac{1}{4}'')} = 22176 \text{ in/min speed flow}$$
$$= 1848 \text{ ft/min}$$

As the liquid exits slits 30 it strikes the cup-like configured holes 32 causing rotor 18 to spin, if not subject to friction, at approximately 9000 rpm as calculated below:

$$\frac{22176}{(\frac{3}{4}'')\,(\pi)} = 9412 \text{ rpm rotation speed of atomizer}$$

It should be pointed out that because of the friction at ball bearing 20 this speed will be somewhat reduced. However, even taking friction into consideration with rotor 18 acting as a fly wheel, spinning at such high speed increases the momentum of the liquid, forcing it upward along the walls surrounding holes 32 of rotor 18. As the liquid reaches the top of holes 32 at the top of rotor 18, it is sheared into fine droplets and sprayed-/atomized in 360° circle around rotor 18. It is clear from the unique design of the present invention that the liquid to be atomized is therefor completely unaffected by the surrounding conditions, that is, vacuum or under sub-ambient pressure conditions. Consequently, the liquid itself effectively acts as a driving force for the atomizer 10 of the present invention.

Although this invention has been described with reference to a particular embodiment, it will be understood that this invention is also capable of further and other embodiments within the spirit and scope of the appended claims.

I claim:

1. A self-propelled, rotary, liquid atomizer, comprising:

means for providing a source of liquid under pressure;

a feed tube operably connected at one end thereof to said pressurized liquid source, said feed tube including an elongated structure having a hollow interior surrounded by a side wall and closed at the other end thereof, and plurality of slits in said side wall adjacent said closed end for permitting said pressurized liquid to pass therethrough, said slits in said side wall of said feed tube being configured to be substantially tangential to the circumference of the inside wall surface of said feed tube;

a ball bearing assembly rotatably secured to said closed end of said feed tube;

a rotor fixedly secured to said ball bearing assembly for rotation therewith, said rotor being in the form of a body having a plurality of circumferentially spaced apart holes formed only on the top surface of said body and extending longitudinally approximately midway through said body, with that portion of said body encompassing each of said holes, respectively, having an opening therein adjacent each of said slits in said side wall of said feed tube in order to receive said liquid therethrough such that said pressurized liquid acts as the motive force as it impinges upon said body of said rotor surrounding said holes in order to rotatably drive said rotor as well as causing atomization of said liquid to take place as said liquid exits from each of said holes in the top surface of said body of said rotor.

2. A self-propelled, rotary, liquid atomizer as defined in claim 1 wherein said circumferentially spaced-apart holes are located in said rotor, and each of said holes having their longitudinal axis at approximately 12° from the vertical.

3. A self-propelled, rotary, liquid atomizer as defined in claim 2 wherein said feed tube is directly connected to said pressurized liquid source means.

4. A self-propelled, rotary, liquid atomizer as defined in claim 3 wherein said ball bearing assembly is secured to said closed end of said feed tube by means of a bolt.

* * * * *